US010325617B2

(12) United States Patent
Yang et al.

(10) Patent No.: US 10,325,617 B2
(45) Date of Patent: Jun. 18, 2019

(54) ELECTRONIC DEVICE AND METHOD FOR CLASSIFYING VOICE AND NOISE

(71) Applicant: SAMSUNG ELECTRONICS CO., LTD., Suwon-si, Gyeonggi-do (KR)

(72) Inventors: Jae Mo Yang, Suwon-si (KR); Beak Kwon Son, Yongin-si (KR); Gang Youl Kim, Suwon-si (KR); Chul Min Choi, Seoul (KR); Ga Hee Kim, Yongin-si (KR); Ho Chul Hwang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 27 days.

(21) Appl. No.: 15/436,030

(22) Filed: Feb. 17, 2017

(65) Prior Publication Data

US 2017/0243602 A1 Aug. 24, 2017

(30) Foreign Application Priority Data

Feb. 19, 2016 (KR) ..... 10-2016-0020049

(51) Int. Cl.

| | |
|---|---|
| ***G10L 25/84*** | (2013.01) |
| ***G10L 25/21*** | (2013.01) |
| ***G10L 21/0264*** | (2013.01) |
| *G10L 21/0232* | (2013.01) |
| *G10L 21/0216* | (2013.01) |

(52) U.S. Cl.

CPC ..... *G10L 25/84* (2013.01); *G10L 21/0264* (2013.01); *G10L 25/21* (2013.01); *G10L 21/0232* (2013.01); *G10L 2021/02166* (2013.01)

(58) Field of Classification Search

CPC ..... G10L 25/84; G10L 21/0264; G10L 25/21
USPC ..... 704/233
See application file for complete search history.

(56) References Cited

U.S. PATENT DOCUMENTS

| | | | | |
|---|---|---|---|---|
| 8,626,498 | B2 | 1/2014 | Lee | |
| 8,954,324 | B2 | 2/2015 | Wang et al. | |
| 2009/0089053 | A1 | 4/2009 | Wang et al. | |
| 2011/0208520 | A1 | 8/2011 | Lee | |
| 2012/0140946 | A1* | 6/2012 | Yen | H04R 1/1083 381/92 |
| 2014/0369509 | A1* | 12/2014 | Fukamachi | G01S 13/93 381/56 |
| 2015/0131814 | A1* | 5/2015 | Usher | G06F 3/017 381/123 |

(Continued)

*Primary Examiner* — Richemond Dorvil
*Assistant Examiner* — Rodrigo A Chavez
(74) *Attorney, Agent, or Firm* — Nixon & Vanderhye P.C.

(57) ABSTRACT

An electronic device includes a first microphone that receives a sound generated for a specific time period, from the outside, a second microphone, which is disposed at a location spaced apart from the first microphone and which receives the sound, an audio converter comprising audio converting circuitry, and a processor electrically connected with the first microphone, the second microphone, and the audio converter. The processor is configured to convert the sound obtained from the first microphone, into a first signal and to convert the sound obtained from the second microphone, into a second signal, using the audio converter, and to determine the sound, which is generated for the specific time period, as a voice or a noise based on a frequency-related correlation between the first signal and the second signal.

8 Claims, 12 Drawing Sheets

(56) References Cited

U.S. PATENT DOCUMENTS

| | | | | |
|---|---|---|---|---|
| 2015/0172814 | A1* | 6/2015 | Usher | H04R 3/005 381/92 |
| 2015/0221322 | A1 | 8/2015 | Iyengar et al. | |
| 2015/0364137 | A1 | 12/2015 | Katuri et al. | |
| 2017/0064087 | A1* | 3/2017 | Mani | H04M 9/082 |
| 2017/0180533 | A1* | 6/2017 | Chen | H04M 1/725 |

* cited by examiner

| NARROWBAND | EMBODIMENT | COMPARISON EXAMPLE |
|---|---|---|
| Clean | 4.00 | 3.99 |
| Noise | 3.59 | 3.47 |

| BROADBAND | EMBODIMENT | COMPARISON EXAMPLE |
|---|---|---|
| Clean | 4.10 | 4.08 |
| Noise | 3.50 | 3.41 |

FIG.7A

| NARROWBAND | EMBODIMENT | COMPARISON EXAMPLE |
|---|---|---|
| Mensa | 3.19 | 3.05 |
| Xroad | 2.94 | 2.65 |
| Road | 2.68 | 2.43 |

| BROADBAND | EMBODIMENT | COMPARISON EXAMPLE |
|---|---|---|
| Mensa | 2.66 | 2.53 |
| Xroad | 2.45 | 2.22 |
| Road | 2.24 | 2.02 |

FIG.7B

ELECTRONIC DEVICE AND METHOD FOR CLASSIFYING VOICE AND NOISE

CROSS-REFERENCE TO RELATED APPLICATION

This application is based on and claims priority under 35 U.S.C. § 119 to a Korean patent application filed on Feb. 19, 2016 in the Korean Intellectual Property Office and assigned Serial number 10-2016-0020049, the disclosure of which is incorporated by reference herein in its entirety.

TECHNICAL FIELD

The present disclosure relates generally to technology to distinguish between a voice interval and a noise interval of an audio signal.

BACKGROUND

With the development of electronic technologies, various types of electronic products are being developed and distributed. In particular, an electronic device having a variety of functions, such as a smartphone, a tablet PC, a wearable device, or the like is being widely supplied nowadays. The electronic device may provide a call function to a user. In addition, the electronic device may remove a noise from a signal to improve call quality.

Generally, a conventional electronic device detects a voice and a noise from the signal by using only a characteristic such as energy, a frequency, or the like of the signal that is input to a microphone. In this case, it may be difficult to detect a non-stationary noise of which a magnitude or a frequency is rapidly changed. Furthermore, if a signal to noise ratio (SNR) of the signal is low, it is very difficult to detect a noise.

SUMMARY

Various example of the present disclosure address at least the above-mentioned problems and/or disadvantages and provide at least the advantages described below. Accordingly, an example aspect of the present disclosure provides an electronic device and a method that are capable of accurately detecting a voice and a noise from a signal, in which a non-stationary noise is included, or a signal of which SNR is low.

In accordance with an example aspect of the present disclosure, an electronic device includes a first microphone configured to receive a sound, which is generated for a specific time period, from the outside, a second microphone, which is disposed at a location spaced apart from the first microphone and which is configured to receive the sound, an audio converter comprising audio converting circuitry, and a processor electrically connected with the first microphone, the second microphone, and the audio converter. The processor is configured to convert the sound, which is obtained from the first microphone, into a first signal and to convert the sound, which is obtained from the second microphone, into a second signal, using the audio converter, and to determine the sound, which is generated for the specific time period, as a voice or a noise based on a frequency-related correlation between the first signal and the second signal.

In accordance with an example aspect of the present disclosure, a voice and noise classification method of an electronic device including a first microphone and a second microphone includes converting a sound, which is obtained from the first microphone for a specific time period, into a first signal, converting the sound, which is obtained from the second microphone disposed at a location spaced apart from the first microphone, into a second signal, and determining the sound, which is generated for the specific time period, as a voice or a noise based on a frequency-related correlation between the first signal and the second signal.

In accordance with an example aspect of the present disclosure, an electronic device includes a first microphone that receives a sound, which is generated for a specific time period, from the outside, a second microphone, which is disposed at a location spaced apart from the first microphone and which receives the sound, an audio converter comprising audio converting circuitry, and a processor electrically connected with the first microphone and the second microphone. The processor is configured to convert the sound, which is obtained from the first microphone, into a first signal and to convert the sound, which is obtained from the second microphone, into a second signal, using the audio converter, to determine the sound, which is generated for the specific time period, as a voice if a value associated with a difference between energy of the first signal and energy of the second signal is greater than a specific energy value and a value associated with at least one of spectral variance of the first signal or spectral variance of the second signal is greater than a specified variance value, and to determine the sound, which is generated for the specified time period, as the voice or a noise based on a frequency-related correlation between the first signal and the second signal if the value associated with a difference between the energy of the first signal and the energy of the second signal is less than the specific energy value or the value associated with at least one of the spectral variance of the first signal or the spectral variance of the second signal is less than the specified variance value.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and attendant advantages of the present disclosure will be more apparent and readily appreciated from the following detailed description, taken in conjunction with the accompanying drawings, in which like reference numerals refer to like elements, and wherein:

FIGS. 7A and 7B are tables illustrating an example sound quality comparison results of a signal processed by an electronic device, according to an example embodiment;

Throughout the drawings, it should be noted that like reference numbers are used to depict the same or similar elements, features, and structures.

DETAILED DESCRIPTION

Figure 1:
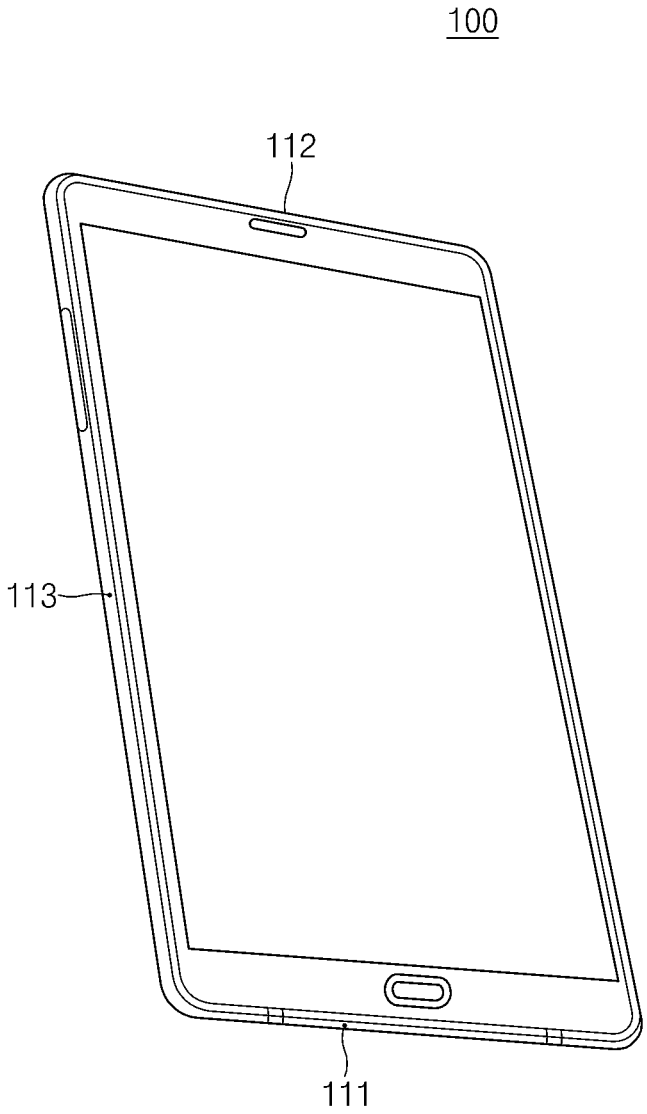
FIG. 1 is a perspective view of an example electronic device, according to an example embodiment.

Various example embodiments of the present disclosure may be described with reference to accompanying drawings. Accordingly, those of ordinary skill in the art will recognize that modifications, equivalents, and/or alternatives to the various example embodiments described herein can be variously made without departing from the scope and spirit of the present disclosure. With regard to description of drawings, similar elements may be marked by similar reference numerals.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, a first user device and a second user device indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used interchangeably with, for example, the expression "suitable for", "having the capacity to", "designed to", "adapted to", "made to", or "capable of". The term "configured to" must not mean only "specifically designed to" in hardware. Instead, the expression "a device configured to" may refer to a situation in which the device is "capable of" operating together with another device or other components. For example, a "processor configured to perform A, B, and C" may refer, for example, to a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in the present disclosure are used to describe specified embodiments and are not intended to limit the scope of the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

According to various embodiments of the present disclosure, an electronic device may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices, or the like, but is not limited thereto. According to various embodiments, a wearable device may include at least one of an accessory type of a device (e.g., a timepiece, a ring, a bracelet, an anklet, a necklace, glasses, a contact lens, or a head-mounted-device (HMD)), one-piece fabric or clothes type of a device (e.g., electronic clothes), a body-attached type of a device (e.g., a skin pad or a tattoo), or a bio-implantable type of a device (e.g., implantable circuit), or the like, but is not limited thereto.

According to another embodiment, the electronic devices may be home appliances. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, or the like, but is not limited thereto.

According to another embodiment, the electronic device may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA), a magnetic resonance imaging (MRI), a computed tomography (CT), scanners, and ultrasonic devices), navigation devices, global navigation satellite system (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs), or internet of things (e.g., light bulbs, various sensors, electric or gas meters, sprinkler devices, fire alarms, thermostats, street lamps, toasters, exercise equipment, hot water tanks, heaters, boilers, and the like), or the like, but is not limited thereto.

According to another embodiment, the electronic devices may include at least one of parts of furniture or buildings/structures, electronic boards, electronic signature receiving devices, projectors, or various measuring instruments (e.g., water meters, electricity meters, gas meters, or wave meters, and the like), or the like, but is not limited thereto. According to various embodiments, the electronic device may be one of the above-described devices or a combination thereof. According to an embodiment, an electronic device may be a flexible electronic device. Furthermore, according to an embodiment of the present disclosure, an electronic device may not be limited to the above-described electronic devices and may include other electronic devices and new electronic devices according to the development of technologies.

Hereinafter, according to various embodiments, electronic devices will be described with reference to the accompanying drawings. The term "user" used herein may refer to a person who uses an electronic device or may refer to a device (e.g., an artificial intelligence electronic device) that uses an electronic device.

FIG. 1 is a perspective view illustrating an example electronic device, according to an example embodiment of the present disclosure.

Referring to FIG. 1, according to an embodiment, an electronic device 100 may include a first microphone 111, a second microphone 112, and a third microphone 113.

The first microphone 111 may receive a sound from the outside. The sound received by the first microphone 111 may be converted into an electrical signal. The first microphone 111 may be exposed through an upper portion of a housing of the electronic device 100. For example, the first microphone 111 may be exposed through a side surface of the housing of the electronic device 100. In FIG. 1, it is illustrated that the first microphone 111 is exposed through the side surface of the housing of the electronic device 100. However, embodiments of the present disclosure are not limited thereto. For example, the first microphone 111 may be exposed through a lower portion of a front surface or a rear surface of the housing of the electronic device 100.

The second microphone 112 may receive the sound at a location that is spaced apart from the first microphone 111. The second microphone 112 may be located at a distance of, for example, about 10 cm to about 15 cm. In FIG. 1, it is illustrated that the second microphone 112 is exposed through the side surface of the housing of the electronic device 100. However, embodiments of the present disclosure are not limited thereto. For example, the second microphone 112 may be exposed through an upper portion of a front surface or a rear surface of the housing of the electronic device 100.

According to an embodiment, a frequency band of the sound that is determined as a voice may be changed in accordance with a distance between the first microphone 111 and the second microphone 112. For example, in the case where the distance between the first microphone 111 and the second microphone 112 is within about 10 cm to about 15 cm, a frequency in which the corresponding distance is used as a wavelength may be about 2.3 kHz to about 3.4 kHz, and the sound of 1 kHz or less may be classified into a voice or a noise.

The third microphone 113 may disposed at a location that is spaced apart from the first microphone 111 and the second microphone 112. The third microphone 113 may be configured to receive the sound. A distance between the third microphone 113 and the first microphone 111 and a distance between the third microphone 113 and the second microphone 112 may be different from each other. For example, the third microphone 113 may be exposed through a left end or a right end of the housing of the electronic device 100. In FIG. 1, it is illustrated that the third microphone 113 is exposed through the side surface of the housing of the electronic device 100. However, embodiments of the present disclosure are not limited thereto. For example, the third microphone 113 may be exposed through a center area of the rear surface of the housing of the electronic device 100. In FIG. 1, it is illustrated that the electronic device 100 includes the third microphone 113. However, the electronic device 100 may include only the first microphone 111 and the second microphone 112.

The electronic device 100 may receive the sound, which is generated for the same time period, by using each of the first microphone 111 and the second microphone 112 (or the first microphone 111, the second microphone 112, and the third microphone 113). The electronic device 100 may convert sounds, which is received by the first microphone 111 and the second microphone 112 (or the first microphone 111, the second microphone 112, and the third microphone 113), into first and second signals (or the first signal, the second signal, and third signal), respectively. The electronic device 100 may determine the sounds as voices or noises based on magnitude squared coherence (MSC) associated with the first signal and the second signal (or the first signal, the second signal, and the third signal).

Below, the operation of determining the sound, which is received by the first microphone 111 and the second microphone 112 (or the first microphone 111, the second microphone 112 and the third microphone 113), as a voice or a noise will be described with reference to FIGS. 2 to 4 in detail.

Figure 2:
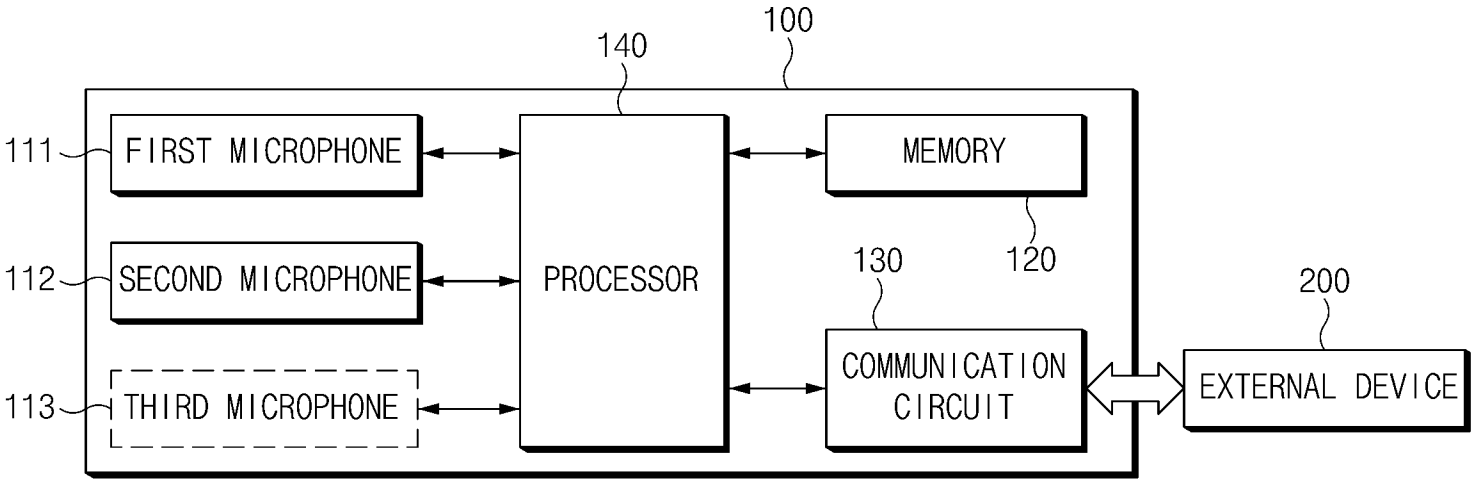
FIG. 2 is a block diagram illustrating an example configuration of an electronic device, according to an example embodiment.

FIG. 2 is a block diagram illustrating an example configuration of an electronic device, according to an example embodiment of the present disclosure.

Figure 8:
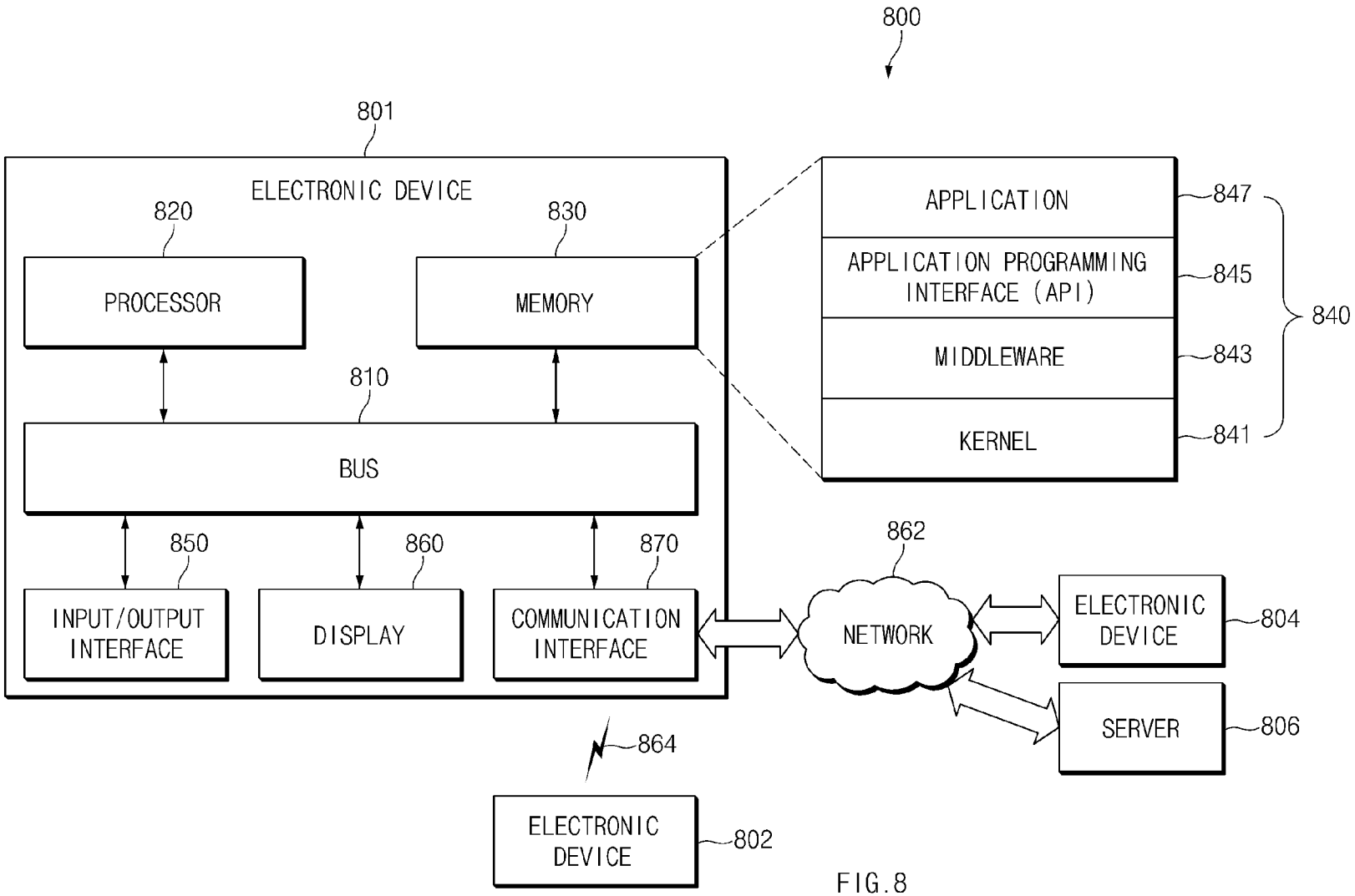
FIG. 8 is a diagram illustrating an example electronic device in a network environment, according to various example embodiments.
Figure 9:
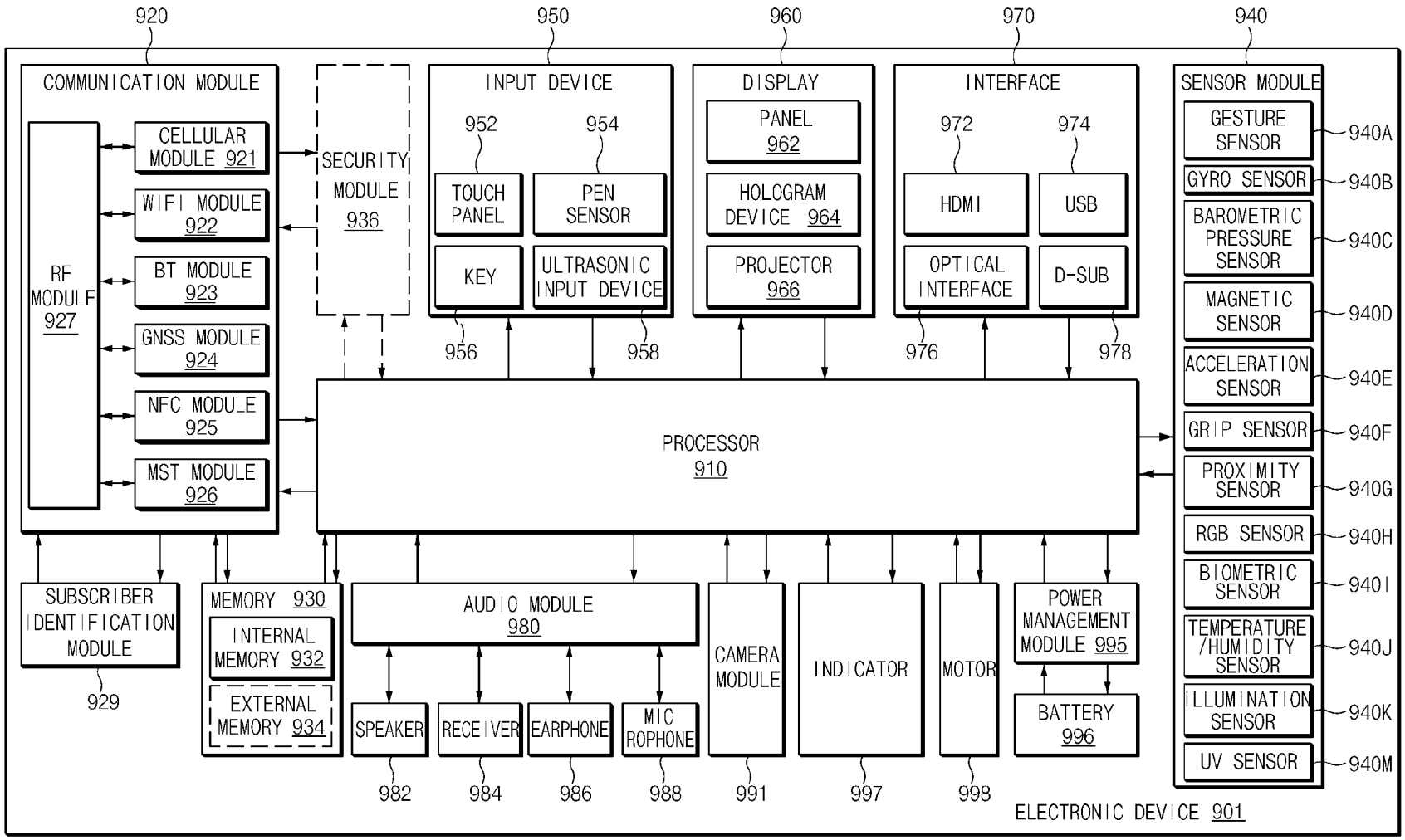
FIG. 9 is a block diagram illustrating an example electronic device, according to an example embodiment.

Referring to FIG. 2, according to an embodiment, the electronic device 100 may include the first microphone 111, the second microphone 112, the third microphone 113, a memory 120 (e.g., a memory 830 or a memory 930 illustrated in FIGS. 8 and 9, respectively), a communication circuit 130, and a processor (e.g., including processing circuitry) 140 (e.g., a processor 820 or a processor 910 illustrated in FIGS. 8 and 9, respectively).

The electronic device 100 may be a device that is capable of receiving a sound from the outside. The electronic device 100 may determine the sound, which is received from the outside, as a voice or a noise. For example, the electronic device 100 may be one of various devices, which support a call function or a voice recognition function, such as a smartphone, a tablet PC, a wearable device, a home smart device, and the like, but is not limited thereto.

Each of the first microphone 111, the second microphone 112, and the third microphone 113 may receive the sound, which is generated for a specific time period, from the outside. Sounds received by the first microphone 111, the second microphone 112, and the third microphone 113 may be converted into electrical signals (e.g., a first signal, a second signal, and a third signal), respectively. A specific time period may be a time period including one frame. A specific time period may be a time period including two or more frames. A frame length of an electrical signal may be about 20 msec to about 30 msec.

The memory 120 (e.g., the memory 830 or the memory 930) may store the electrical signal. If the electrical signal is determined as a voice signal or a noise signal, the memory 120 (e.g., the memory 830 or the memory 930) may store the electrical signal together with a flag indicating a voice or a noise.

The communication circuit 130 may include various circuitry and communicate with an external device 200. For example, in the case where the electronic device 100 provides a call function, the communication circuit 130 may send the sounds, which are received by the first microphone 111, the second microphone 112 and the third microphone 113, to the external device 200. As another example, in the case where the electronic device 100 provides a voice recognition function, the communication circuit 130 may send a command corresponding to a voice recognition result to the external device 200.

The processor 140 (e.g., the processor 820 or the processor 910 illustrated in FIGS. 8 and 9, respectively) may include various processing circuitry and be electrically connected with the first microphone 111, the second microphone 112, the third microphone 113, the memory 120 (e.g., the memory 830 or the memory 930), and the communication circuit 130. The processor 140 (e.g., the processor 820 or the processor 910 illustrated in FIGS. 8 and 9, respectively) may control the first microphone 111, the second microphone 112, the third microphone 113, the memory 120 (e.g., the memory 830 or the memory 930 illustrated in FIGS. 8 and 9, respectively), and the communication circuit 130.

According to an embodiment, the processor 140 (e.g., the processor 820 or the processor 910) may convert the sound, which is obtained from the first microphone 111 for a specific time period (e.g., 1 frame), into the first signal and may convert the sound, which is obtained from the second microphone 112 for a specific time period, into the second signal, by using an audio converter (not illustrated) included in the electronic device 100. For example, sounds obtained by the first microphone 111 and the second microphone 112 may be converted first and second analog signals, respectively. The first and second analog signals may be sampled at specific intervals, respectively. Therefore, the first analog signal and the second analog signal may be converted into a first discrete signal and a second discrete signal, respectively. In the case where a sampling rate is 16000 sample/sec, a signal corresponding to one frame may include 320 to 480 samples. For example, the processor 140 (e.g., the processor 820 or the processor 910) may obtain the first and second signals being frequency signals by converting the first and second discrete signals into the frequency signals in a frequency domain, respectively.

According to an embodiment, in the case where the third microphone 113 is included in the electronic device 100, the processor 140 (e.g., the processor 820 or the processor 910 illustrated in FIGS. 8 and 9, respectively) may convert the sound, which is obtained from the third microphone 113, into the third signal using the audio converter. For example, the processor 140 (e.g., the processor 820 or the processor 910 illustrated in FIGS. 8 and 9, respectively) may convert the sound, which is obtained from the third microphone 113, into the third signal by using the above-mentioned method.

According to an embodiment, the processor 140 may determine the sound, which is generated for a specific time period (e.g., one frame), as a voice or a noise based on a frequency-related correlation between the first signal and the second signal. For example, the processor 140 (e.g., the processor 820 or the processor 910 illustrated in FIGS. 8 and 9, respectively) may determine the sound, which is generated for a specific time period (e.g., one frame), as the voice or the noise based on an autocorrelation function of the first signal, an autocorrelation function of the second signal, and a cross-correlation function of the first signal and the second signal. For example, the processor 140 (e.g., the processor 820 or the processor 910 illustrated in FIGS. 8 and 9, respectively) may determine the sound, which is generated for a specific time period (e.g., one frame), as the voice or the noise based on MSC of the first signal and the second signal. If the MSC is greater than a specified value, the processor 140 (e.g., the processor 820 or the processor 910 illustrated in FIGS. 8 and 9, respectively) may determine the sound, which is generated for a corresponding time period, as the voice. If the MSC is less than the specified value, the processor 140 may determine the sound, which is generated for the corresponding time period, as the noise. Favorably, a threshold value of the MSC which is a reference for determining the sound as the voice or the noise may be 0.6 to 0.7. The threshold value of the MSC may be variously changed. The threshold value of the MSC may decrease to reduce the number of times that the voice is misinterpreted as the noise. On the other hand, the threshold value of the MSC may increase to reduce the number of times that the noise is misinterpreted as the voice. In the case where the processor 140 determines the sound, which is generated for a specific time period, as the voice or the noise based on the MSC, the processor 140 (e.g., the processor 820 or the processor 910) does not require an initial noise interval to determine the voice or the noise because the processor 140 determines a signal of the corresponding frame as the voice or the noise by using only the signal of one frame.

According to an embodiment, the processor 140 (e.g., the processor 820 or the processor 910 illustrated in FIGS. 8 and 9, respectively) may determine the sound, which is generated for a specific time period, as the voice or the noise based on at least one or more of a correlation between the first signal and the second signal, a correlation between the second signal and the third signal, or a correlation between the third signal and the first signal. For example, the processor 140 (e.g., the processor 820 or the processor 910 illustrated in FIGS. 8 and 9, respectively) may determine the sound, which is generated for a specific time period, as the voice or the noise based on MSC of the first signal and the second signal, MSC of the second signal and the third signal, and MSC of the third signal and the first signal. For example, if the sum of the MSC of the first signal and the second signal, the MSC of the second signal and the third signal, and the MSC of the third signal and the first signal is greater than a specified value, the processor 140 (e.g., the processor 820 or the processor 910 illustrated in FIGS. 8 and 9, respectively) may determine the sound, which is generated for the corresponding time period, as the voice. If the sum thereof is less than the specified value, the processor 140 may determine the sound, which is generated for the corresponding time period, as the noise.

According to an embodiment, the processor 140 (e.g., the processor 820 or the processor 910 illustrated in FIGS. 8 and 9, respectively) may assign different weights to the correlation between the first signal and the second signal, the correlation between the second signal and the third signal, and the correlation between the third signal and the first signal, based on a distance between the first microphone 111 and the second microphone 112, a distance between the second microphone 112 and the third microphone 113, and a distance between the third microphone 113 and the first microphone 111. For example, the processor 140 (e.g., the processor 820 or the processor 910 illustrated in FIGS. 8 and 9, respectively) may obtain information about a frequency of the first signal, the second signal, and/or the third signal. The processor 140 (e.g., the processor 820 or the processor 910 illustrated in FIGS. 8 and 9, respectively) may assign a high weight to a correlation between signals, which are obtained by two microphones having a distance suitable to classify the sound having the corresponding frequency into the voice or the noise. For example, in the case where a high-frequency signal is obtained, the processor 140 (e.g., the processor 820 or the processor 910 illustrated in FIGS. 8 and 9, respectively) may assign a high weight to a correlation between signals obtained by two microphones, which are adjacent to each other, from among the first microphone 111, the second microphone 112, and the third microphone 113. As another example, in the case where a low-frequency signal is obtained, the processor 140 (e.g., the processor 820 or the processor 910 illustrated in FIGS. 8 and 9, respectively) may assign a high weight to a correlation between signals obtained by two microphones, which are far from each other, from among the first microphone 111, the second microphone 112, and the third microphone 113.

For example, after respectively multiplying different weights and the MSC of the first signal and the second signal, the MSC of the second signal and the third signal, and the MSC of the third signal and the first signal, the processor 140 (e.g., the processor 820 or the processor 910 illustrated in FIGS. 8 and 9, respectively) may determine the sum of pieces of multiplied MSC. The weight may be '0'. The processor 140 may determine the sound, which is generated for a specific time period, as the voice or the noise based on the sum thereof to which the weight is applied.

According to an embodiment, if the value that is associated with at least one or more of energy of the first signal, energy of the second signal, spectral variance of the first signal, or spectral variance of the second signal is greater than the specified value, the processor 140 (e.g., the processor 820 or the processor 910 illustrated in FIGS. 8 and 9, respectively) may determine the sound, which is generated for a specific time period, as the voice. For example, if the value associated with the difference between the energy of the first signal and the energy of the second signal is greater than the specified value, the processor 140 (e.g., the processor 820 or the processor 910 illustrated in FIGS. 8 and 9, respectively) may determine the sound, which is generated for a specific time period, as the voice. As another example, if the value associated with at least one of the spectral variance of the first signal or the spectral variance of the second signal is greater than the specified value, the processor 140 (e.g., the processor 820 or the processor 910 illustrated in FIGS. 8 and 9, respectively) determine the sound, which is generated for a specific time period, as the voice. Below, the operation of determining the sound as the voice by using the energy and the spectral variance of the first signal and the second signal will be described with reference to FIG. 4 in greater detail below.

According to various embodiments, after determining the sound as the voice or the noise, the processor 140 (e.g., the processor 820 or the processor 910 illustrated in FIGS. 8 and 9, respectively) may store information indicating the voice or the noise in the memory 120 (e.g., the memory 830 or the memory 930 illustrated in FIGS. 8 and 9, respectively) together with a signal corresponding to the sound. The stored information may be used to remove the noise of the transmission signal, to remove the received echo, or to strengthen the received voice. For example, the processor 140 (e.g., the processor 820 or the processor 910 illustrated in FIGS. 8 and 9, respectively) may amplify a signal in an interval in which the signal is determined as the voice, and may attenuate a signal in an interval in which the signal is determined as the noise. The processor 140 may use, for example, information stored at a point in time when a voice activity detection (VAD) scheme is applied thereto. After removing the noise of the transmission signal, removing the received echo, or strengthening the received voice, the processor 140 (e.g., the processor 820 or the processor 910) may send the signal to the external device 200 by using the communication circuit 130. After removing the noise of the transmission signal, removing the received echo, or strengthening the received voice, the processor 140 (e.g., the processor 820 or the processor 910 illustrated in FIGS. 8 and 9, respectively) may perform voice recognition and may send a command corresponding to the voice recognition result to the external device 200.

The external device 200 may receive a signal or a command from the electronic device 100. The external device 200 may output the signal received from the electronic device 100. The external device 200 may perform a function corresponding to the command received from the electronic device 100.

Figure 3:
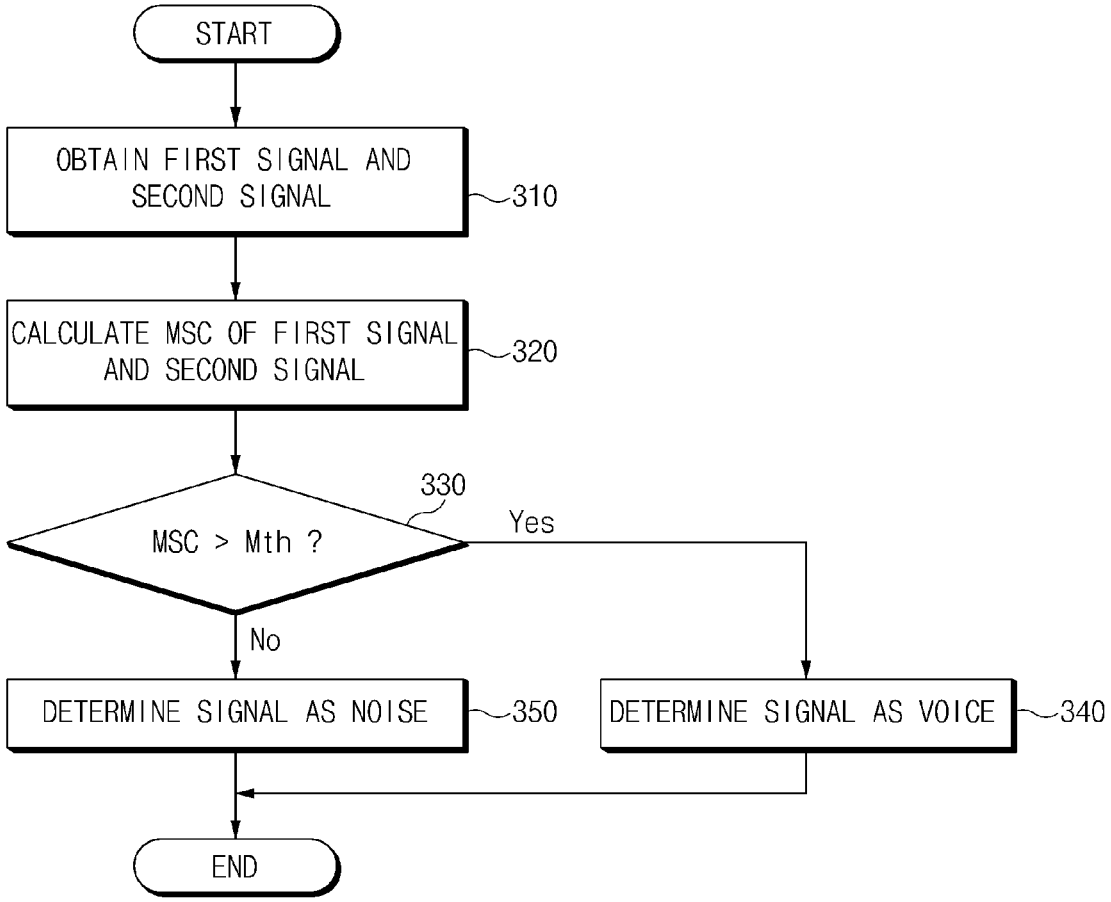
FIG. 3 is a flowchart illustrating an example voice and noise classification method of an electronic device, according to an example embodiment.

FIG. 3 is a flowchart illustrating an example voice and noise classification method of an electronic device, according to an example embodiment of the present disclosure.

The flowchart illustrated in FIG. 3 may include operations which the electronic device 100 illustrated in FIGS. 1 and 2 processes. Therefore, even though omitted below, the above description about the electronic device 100 may be applied to the flowchart shown in FIG. 3 with reference to FIGS. 1 and 2.

Referring to FIG. 3, in operation 310, the electronic device 100 (e.g., the processor 140, the processor 820, or the processor 910) may obtain a first signal and a second signal. For example, the electronic device 100 may detect a sound, which is generated for a specific time period, by using the first microphone 111 and the second microphone 112. The electronic device 100 may convert the sound, which is detected by the first microphone 111 and the second microphone 112, into a discrete signal and may convert the discrete signal into a frequency signal. The first signal may be a frequency signal corresponding to the sound detected by the first microphone 111, and the second signal may be a frequency signal corresponding to the sound detected by the second microphone 112. For example, the electronic device 100 may obtain the first signal and the second signal of about 20 msec to about 30 msec, which includes one frame.

In operation 320, the electronic device 100 (e.g., the processor 140, the processor 820, or the processor 910) may calculate (determine) the MSC of the first signal and the MSC of the second signal. For example, the electronic device 100 may calculate power spectrum (or an autocorrelation function) of the first signal and power spectrum (or an autocorrelation function) of the second signal. The electronic device 100 may calculate cross power spectrum (or a correlation function) between the first signal and the second signal. The electronic device 100 may calculate the MSC by dividing a square of the cross power spectrum by the result obtained by multiplying the power spectrum of the first signal and the power spectrum of the second signal together. The electronic device 100 may calculate the MSC by using a signal, of which a frame is earlier than a frame of the first signal and the second signal, together with the first signal and the second signal.

An example Equation for calculating the MSC is as follows:

$$MSC(f) = \frac{|S_{xy}(f)|^2}{S_{xx}(f)S_{yy}(f)} \quad \text{[Equation 1]}$$

Hereinafter, $S_{xx}$ may be the power spectrum of the first signal. $S_{yy}$ may be the power spectrum of the second signal. $S_{xy}$ may be the cross power spectrum of the first signal and the second signal. 'f' may be a frequency.

$$S_{xx}(f) \approx \sum_n X_n(f)X_n^*(f) \quad \text{[Equation 2]}$$

$$S_{yy}(f) \approx \sum_n Y_n(f)Y_n^*(f)$$

$$S_{xy}(f) \approx \sum_n X_n(f)Y_n^*(f)$$

Hereinafter, $X_n$ may be the first signal. $Y_n$ may be the second signal. 'n' may be a frame number.

In operation 330, the electronic device 100 (e.g., the processor 140, the processor 820, or the processor 910) may compare the MSC with a specified value. For example, the electronic device 100 may determine whether the MSC is greater than the specified threshold value Mth. In the case where a voice is input to the first microphone 111 and the second microphone 112, frequency characteristics of the first signal and the second signal may be similar to each other because the voice is generated a user. Accordingly, in a frame in which the voice is included, the magnitude of $S_{xy}$ being a correlation function of the first signal and the second signal may be great. On the other hand, in the case where a noise is input to the first microphone 111 and the second microphone 112, frequency characteristics of the first signal and the second signal may be different from each other because the noise is generated from a specific direction. Accordingly, in a frame in which only the noise is included, the magnitude of $S_{xy}$ being the correlation function of the first signal and the second signal may be small. The magnitude of MSC may be proportional to the magnitude of $S_{xy}$.

In the case where the MSC is greater than the specified value, in operation 340, the electronic device 100 (e.g., the processor 140, the processor 820, or the processor 910) may determine the signal as the voice. As described above, in the case where the voice is included in the first signal and the second signal, the magnitude of the MSC may be greater than the specified value. Accordingly, the electronic device 100 may recognize the signal, which corresponds to a frame in which the MSC is greater than the specified value, as the voice.

In the case where the MSC is less than the specified value, in operation 350, the electronic device 100 (e.g., the processor 140, the processor 820, or the processor 910) may determine the signal as the noise. As described above, in the case where the voice is not included in the first signal and the second signal, the magnitude of the MSC may be less than the specified value. Accordingly, the electronic device 100 may recognize the signal, which corresponds to a frame in which the MSC is less than the specified value, as the noise.

As described above, in the case where the sound is received by using a plurality of microphones disposed at locations, which are spaced apart from each other, a frame in which a voice is included and a frame in which the voice is not included may indicate different characteristics due to a spatial characteristic of the sound, in which the voice is generated at a specific location and the noise is generated from a specific direction. In the case of the frame in which the voice is included, it is indicated that a correlation between the first signal and the second signal is high. In the case of the frame in which the voice is not included, it is indicated that the correlation between the first signal and the second signal is low. The accuracy to distinguish between the voice and the noise may be improved by using the above-mentioned correlation. In addition, even though a distance between a user and the electronic device 100 is far, the above-mentioned characteristic is maintained. Accordingly, the electronic device 100, such as a home smart device, or the like, which recognizes the voice generated at a location far from the electronic device 100 may accurately distinguish between a voice and a noise.

Figure 4:
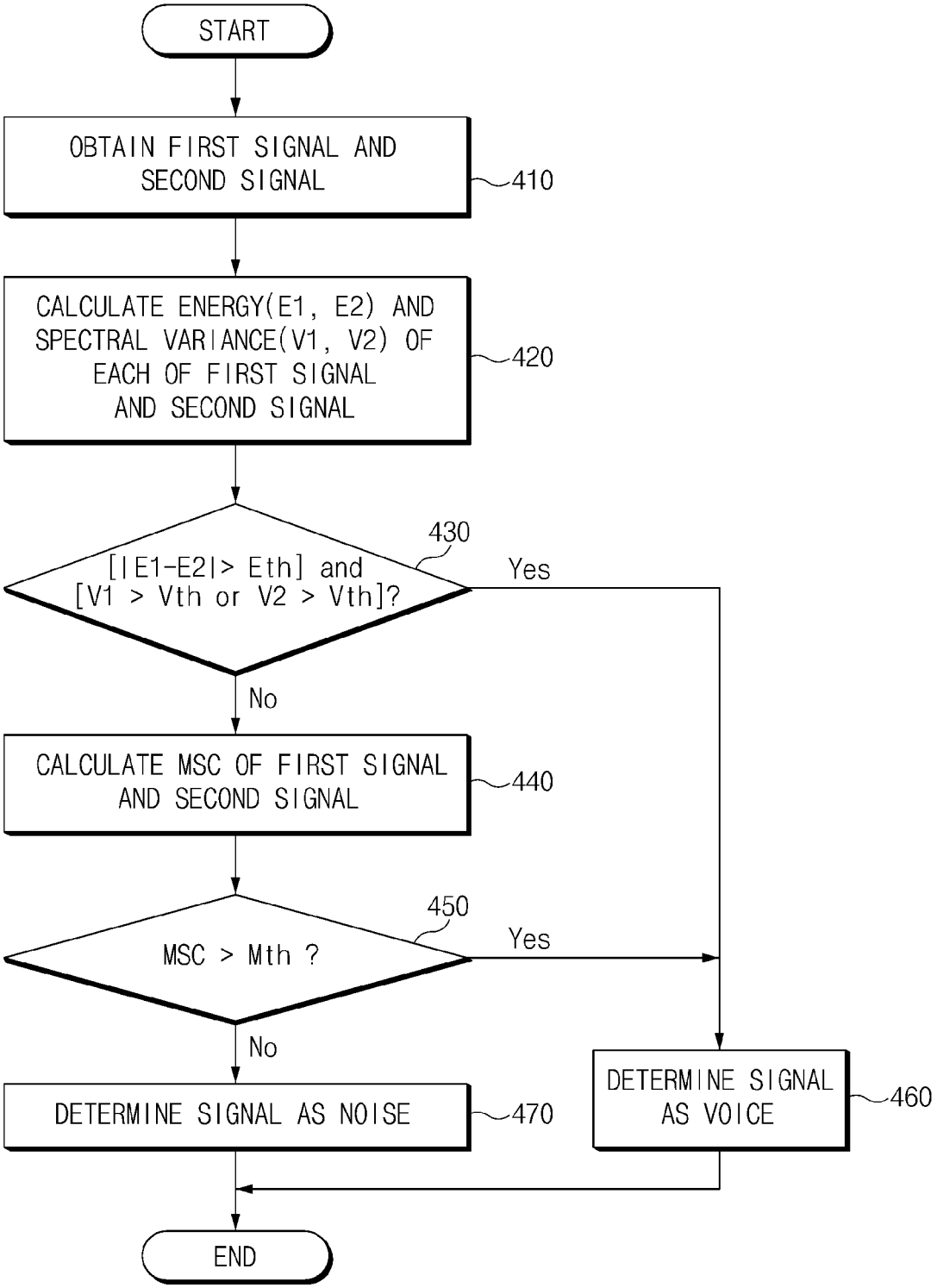
FIG. 4 is a flowchart illustrating an example voice and noise classification method of an electronic device, according to an example embodiment.

FIG. 4 is a flowchart illustrating an example voice and noise classification method of an electronic device, according to an example embodiment of the present disclosure. For convenience of description, a detailed description about an operation that is the same as an operation described with reference to FIG. 3 will not be repeated here.

The flowchart illustrated in FIG. 4 may include operations which the electronic device 100 illustrated in FIGS. 1 and 2 processes. Therefore, even though omitted below, the above description about the electronic device 100 may be applied to the flowchart shown in FIG. 4 with reference to FIGS. 1 and 2.

Referring to FIG. 4, in operation 410, the electronic device 100 (e.g., the processor 140, the processor 820, or the processor 910) may obtain a first signal and a second signal.

In operation 420, the electronic device 100 (e.g., the processor 140, the processor 820, or the processor 910) may calculate energy and spectral variance of each of the first signal and the second signal. For example, the electronic device 100 may calculate energy E1 of the first signal based on a square of a magnitude of the first signal, and the electronic device 100 may calculate energy E2 of the second signal based on a square of a magnitude of the second signal. The electronic device 100 may calculate spectral variance V1 of the first signal based on frequency distribution of the first signal, and the electronic device 100 may calculate spectral variance V2 of the second signal based on frequency distribution of the second signal.

In operation 430, the electronic device 100 (e.g., the processor 140, the processor 820, or the processor 910) may compare at least a portion of energy and spectral variance of each of the first signal and the second signal with a specified value.

According to an embodiment, the electronic device 100 may determine whether a difference |E1−E2| between the energy of the first signal and the energy of the second signal is greater than a specified threshold value Eth. For example, since the voice of a user of the electronic device 100 is generated at a location that is adjacent to the electronic device 100, the user voice may be propagated toward a specific location, and in particular, the user voice may be propagated toward the first microphone 111. Accordingly, in the case where a voice is included in the first signal and the second signal, an energy difference between the first signal, which is obtained by the first microphone 111 adjacent to a location at which the voice is generated, and the second signal obtained by the second microphone 112 that is far from a location in which the voice is generated may be great. Accordingly, in operation 460, the electronic device 100 may determine a signal, in which the energy difference is greater than the specified value, as a voice. As another example, since the noise is generated at a location far from the electronic device 100 and is distributed or scattered in a specific direction, in the case where the voice is not included in the first signal and the second signal, the energy difference between the first signal and the second signal may be small. Accordingly, the electronic device 100 may perform operation 440 and operation 450 on a signal in which the energy difference is less than the specified value and may determine a sound as a voice or a noise.

According to an embodiment, the electronic device 100 may determine whether spectral variance V1 of the first signal or spectral variance V2 of the second signal is greater than a specified threshold value Vth. For example, since the voice changes abruptly in process of time, in the case where the voice is included in the first signal or the second signal, spectral variance of the first signal or the second signal may be great. Accordingly, the electronic device 100 may determine a signal, in which the spectral variance of the first signal or the second signal is greater than the specified value, as a voice. As another example, since the degree of change of the noise is smaller than the degree of change of the voice (e.g., a white noise), in the case where the voice is not included in the first signal or the second signal, spectral variance of the first signal or the second signal may be small. Accordingly, the electronic device 100 may determine a signal, in which the spectral variance of the first signal or the second signal is less than the specified value, as the noise.

In the case where the energy difference |E1−E2| between the first signal and the second signal is greater than the specified value Eth and the spectral variance V1 of the first signal or the spectral variance V2 of the second signal is greater than the specified value Vth, in operation 460, the electronic device 100 may determine the signal as the voice.

In the case where the signal is not determined as the voice, in operation 440, the electronic device 100 (e.g., the processor 140, the processor 820, or the processor 910) may calculate the MSC of the first signal and the second signal.

In operation 450, the electronic device 100 (e.g., the processor 140, the processor 820, or the processor 910) may determine whether the MSC is greater than the specified threshold value Mth.

In the case where the MSC is greater than the specified value Mth, in operation 460, the electronic device 100 (e.g., the processor 140, the processor 820, or the processor 910) may determine the signal as the voice.

In the case where the MSC is less than the specified value Mth, in operation 470, the electronic device 100 (e.g., the processor 140, the processor 820, or the processor 910) may determine the signal as the noise.

As described above, firstly, the sound may be classified into the voice by using a value that is calculated by a simple arithmetic operation such as energy, spectral variance, or the like, compared with the MSC. In the case where the sound is not classified as the voice, secondarily, the sound may be classified as a voice and a noise by using the MSC, thereby reducing processing time for distinguishing between the voice and the noise. In addition, according to an embodiment, since the electronic device 100 may perform additional classification by using the MSC, threshold values such as Eth, Vth, and the like may be set to be higher than that of a conventional electronic device, thereby reducing a false recognition rate at which the noise is determined as the voice.

Figure 5A:
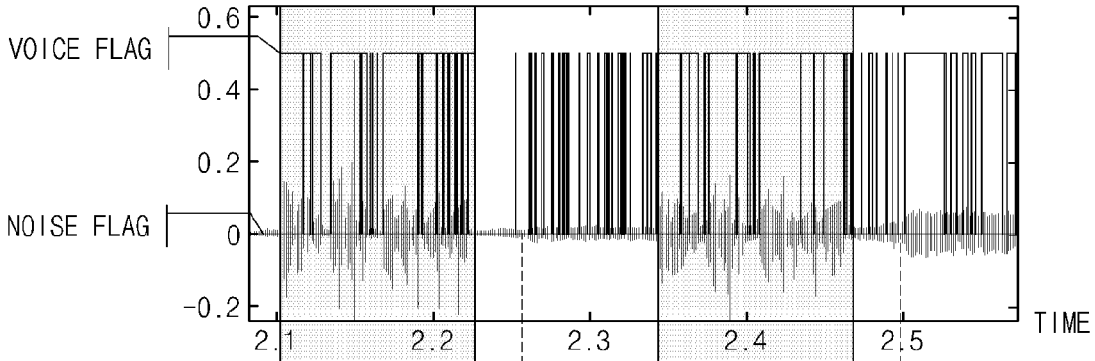
FIGS. 5A and 5B are graphs illustrating an example comparison result in which a voice and a noise is recognized by an electronic device, according to an example embodiment.
Figure 5B:
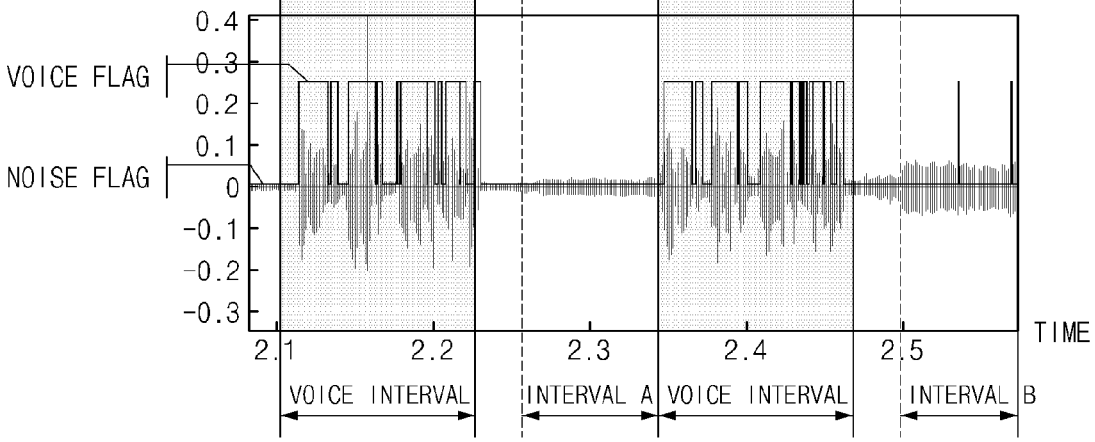

FIGS. 5A and 5B are graphs illustrating an example comparison result in which a voice and a noise is recognized by an electronic device, according to an example embodiment of the present disclosure.

According to a method described with reference to FIG. 4, the embodiment-related experiment result may indicate the result of distinguishing between a noise and a voice based on MSC. A comparison example-related experiment result may indicate the result of distinguishing between a noise and a voice based on energy and spectral variance of a sound received by one microphone. In FIGS. 5A and 5B, a time period surrounded in a box may indicate a time period in which the sound is recognized as the voice, and the remaining time period may indicate a time period in which the sound is recognized as the noise.

Referring to FIG. 5A, in the case where a voice and a noise are distinguished based on the comparison example, it may be determined that a voice interval in which the voice is included mostly includes the voice. However, in the case of an interval, such as interval 'a', interval 'b', and interval 'c', in which a magnitude of the noise is great or in which the change in the width of the noise is great with time, even though the voice is not included in the interval, it may be determined that the voice is included in the interval. Accordingly, since a signal of a noise interval in which the voice is not included is amplified and the noise is not removed, call quality or voice recognition quality may be reduced.

Referring to FIG. 5B, in the case where the voice and the noise are distinguished by using the electronic device according to an embodiment, it may be determined that a voice interval in which the voice is included nearly includes the voice. Furthermore, in spite of an interval, such as interval 'a', interval 'b', and interval 'c', in which a magnitude of the noise is great or in which the change magnitude of the noise is great with time, the electronic device according to an embodiment may determine the corresponding interval as the noise. According to an embodiment, since the electronic device uses correlations of sounds received by a plurality of microphones, the electronic device may distinguish a noise regardless of the magnitude or the change in the width of the noise. A signal of a voice interval is amplified or the noise interval is removed because the voice and the noise are distinguished, thereby improving call quality or voice recognition quality.

Figure 6A:
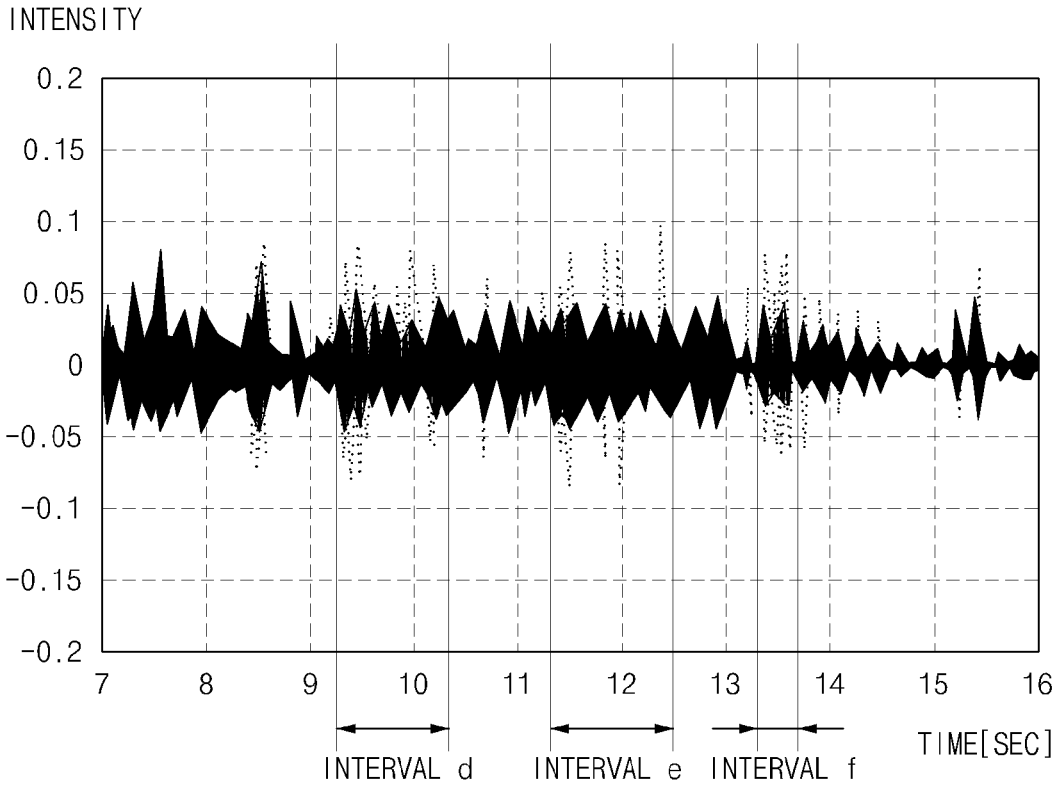
FIGS. 6A and 6B are graphs illustrating an example comparison result in which a signal is processed by an electronic device, according to an example embodiment.
Figure 6B:
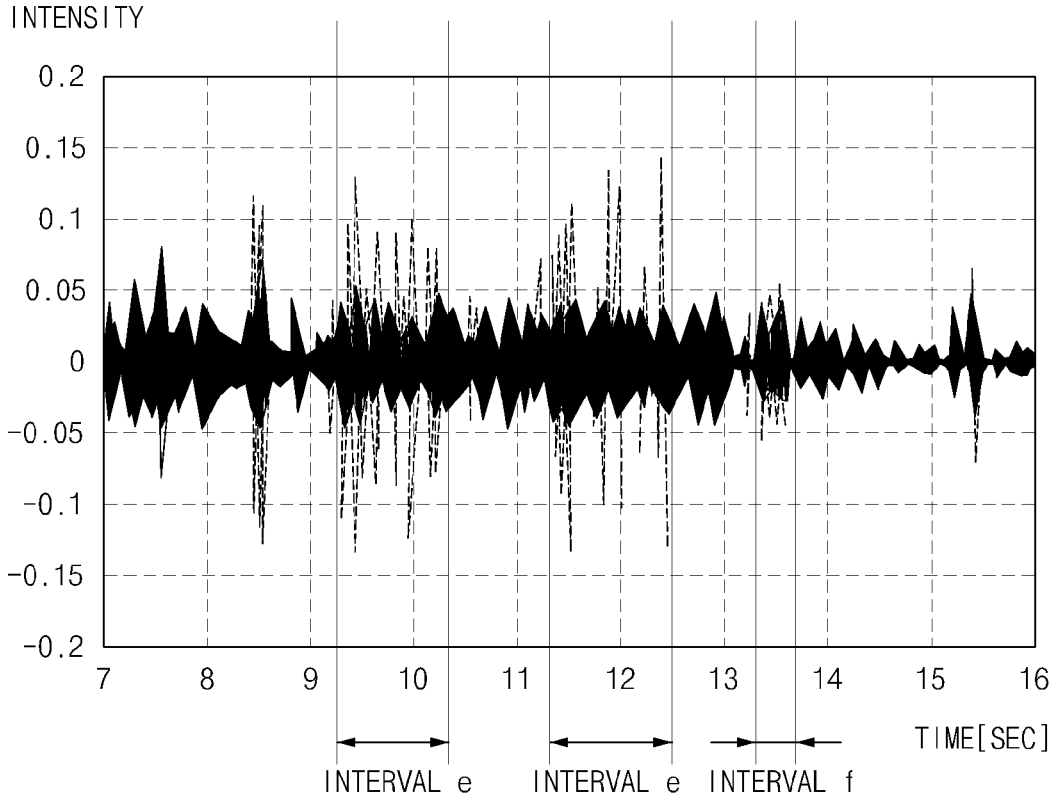

FIGS. 6A and 6B are graphs illustrating an example comparison result in which a signal is processed by an electronic device, according to an example embodiment of the present disclosure.

According to a method described with reference to FIG. 4, the experiment result according to an embodiment may indicate an output signal strengthened by a voice activity detection (VAD) scheme after a noise and a voice are distinguished based on MSC. An experiment result based on a comparison example may indicate an output signal strengthened by the VAD scheme after the noise and the voice are distinguished based on energy and spectral variance of a sound received by one microphone.

Referring to FIG. 6A, after the voice and the noise are distinguished based on the comparison example, an interval in which the sound is determined as the voice may be strengthened. For example, signals included in interval 'd', interval 'e', and interval 'f' may be amplified. A part of an interval including the signal amplified according to the comparison example may be an interval in which a voice is not included. For example, interval 'f' may be an interval in which the voice is not included. Accordingly, in the case where a signal of an interval in which the voice is not included is amplified, call quality or voice recognition quality may be reduced.

Referring to FIG. 6B, after distinguishing between the voice and the noise, the electronic device according to an embodiment may strengthen an interval in which the sound is recognized as the voice. For example, the electronic device may amplify signals of interval 'd' and interval 'e'. Unlike the comparison example, the electronic device according to an embodiment may determine a signal of interval 'e' as the noise and may not amplify a signal of interval 'e'. In the case where the voice and the noise are distinguished by the electronic device, accuracy of the distinction may be improved. Therefore, when the signal is amplified, a gain may be set to be higher than that of the comparison example. The quality of an output signal may be improved because the accuracy of distinguishing between the voice and the noise is improved and the gain of amplifying the voice is set to be high.

FIGS. 7A and 7B are tables illustrating example sound quality comparison results of a signal processed by an electronic device, according to an example embodiment of the present disclosure.

A sound quality evaluation index illustrated in FIGS. 7A and 7B may be calculated according to a perceptual evaluation of speech quality (PESQ) evaluation method being an International Telecommunication Union (ITU) standard. The sound quality evaluation index of a signal processed according to an embodiment may indicate the sound quality evaluation index of the output signal strengthened by a VAD scheme after the noise and the voice are distinguished based on the method described with reference to FIG. 4. The sound quality evaluation index of a signal processed according to the comparison example may indicate the sound quality evaluation index of the output signal strengthened by a VAD scheme after the noise and the voice are distinguished based on energy and spectral variance of a sound received by one microphone.

Referring to FIG. 7A, with regard to a broadband signal and a narrowband signal, the sound quality evaluation index of each of an embodiment-related output signal and a comparison example-related output signal may be calculated in a clean environment, in which the noise is not included, and a noise environment in which a stationary noise is included. Since the embodiment-related output signal obtains a score, which is higher than the comparison example-related output signal, in the clean environment, it may be seen that the electronic device according to an embodiment is operated without a malfunction. In the noise environment, with regard to the narrowband signal and the broadband signal, the embodiment-related output signal obtains a score, which is higher than the comparison example-related output signal by 0.12 and 0.09, respectively. Accordingly, it may be seen that the quality of an output signal will be improved in an environment in which a stationary noise is included by an electronic device according to an embodiment.

Referring to FIG. 7B, with regard to the broadband signal and the narrowband signal, the sound quality evaluation index of the embodiment-related output signal and the comparison example-related output signal may be calculated in a Mensa environment, a Xroad environment, and a Road environment in which a non-stationary noise is included. In the Mensa environment, with regard to the narrowband signal and the broadband signal, the embodiment-related output signal obtains a score that is higher than the comparison example-related output signal by 0.14 and 0.13, respectively. In the Xroad environment, with regard to the narrowband signal and the broadband signal, the embodiment-related output signal obtains a score that is higher than the comparison example-related output signal by 0.29 and 0.23, respectively. In the Road environment, with regard to the narrowband signal and the broadband signal, the embodiment-related output signal obtains a score that is higher than the comparison example-related output signal by 0.25 and 0.22, respectively. As described above, it may be seen that the quality of the output signal will be improved in an environment in which the non-stationary noise is included by the electronic device according to an embodiment. In addition, it may be seen that the sound quality is improved at a point in time when the non-stationary noise is included as compared with the case in which a stationary noise is included.

FIG. 8 is a diagram illustrating an example electronic device in a network environment, according to various example embodiments of the present disclosure.

Referring to FIG. 8, according to various embodiments, an electronic device 801, 802, or 804 or a server 806 may be connected with each other through a network 862 or a local area (or short-range wireless) network 864. The electronic device 801 may include a bus 810, a processor (e.g., including processing circuitry) 820, a memory 830, an input/output (I/O) interface (e.g., including input/output circuitry) 850, a display 860, and a communication interface (e.g., including communication circuitry) 870. According to an embodiment, the electronic device 801 may not include at least one of the above-described elements or may further include other element(s).

The bus 810 may interconnect the above-described elements 810 to 870 and may be a circuit for conveying communications (e.g., a control message and/or data) among the above-described elements.

The processor 820 may include various processing circuitry, such as, for example, and without limitation, one or more of a dedicated processor, a central processing unit (CPU), an application processor (AP), or a communication processor (CP). The processor 820 may perform, for example, data processing or an operation associated with control or communication of at least one other element(s) of the electronic device 801.

The memory 830 may include a volatile and/or nonvolatile memory. For example, the memory 830 may store instructions or data associated with at least one other element(s) of the electronic device 801. According to an embodiment, the memory 830 may store software and/or a program 840. The program 840 may include, for example, a kernel 841, a middleware 843, an application programming interface (API) 845, and/or an application program (or "application") 847. At least a part of the kernel 841, the middleware 843, or the API 845 may be called an "operating system (OS)".

The kernel 841 may control or manage system resources (e.g., the bus 810, the processor 820, the memory 830, and the like) that are used to execute operations or functions of other programs (e.g., the middleware 843, the API 845, and the application program 847). Furthermore, the kernel 841 may provide an interface that allows the middleware 843, the API 845, or the application program 847 to access discrete elements of the electronic device 801 so as to control or manage system resources.

The middleware 843 may perform, for example, a mediation role such that the API 845 or the application program 847 communicates with the kernel 841 to exchange data.

Furthermore, the middleware 843 may process one or more task requests received from the application program 847 according to a priority. For example, the middleware 843 may assign the priority, which makes it possible to use a system resource (e.g., the bus 810, the processor 820, the memory 830, or the like) of the electronic device 801, to at least one of the application program 847. For example, the middleware 843 may process the one or more task requests according to the priority assigned to the at least one, which makes it possible to perform scheduling or load balancing on the one or more task requests.

The API 845 may be an interface through which the application program 847 controls a function provided by the kernel 841 or the middleware 843, and may include, for example, at least one interface or function (e.g., an instruction) for a file control, a window control, image processing, a character control, or the like.

The I/O interface 850 may include various I/O circuitry configured to transmit an instruction or data, input from a user or another external device, to other element(s) of the electronic device 801. Furthermore, the I/O interface 850 may output an instruction or data, received from other component(s) of the electronic device 801, to a user or another external device.

The display 860 may include, for example, a liquid crystal display (LCD), a light-emitting diode (LED) display, an organic LED (OLED) display, a microelectromechanical systems (MEMS) display, or an electronic paper display, or the like, but is not limited thereto. The display 860 may display, for example, various kinds of contents (e.g., a text, an image, a video, an icon, a symbol, or the like) to a user. The display 860 may include a touch screen and may receive, for example, a touch, gesture, proximity, or hovering input using an electronic pen or a portion of a user's body.

The communication interface 870 may include various communication circuitry and may establish communication between the electronic device 801 and an external device (e.g., the first external electronic device 802, the second external electronic device 804, or the server 806). For example, the communication interface 870 may be connected to the network 862 through wireless communication or wired communication to communicate with the external device (e.g., the second external electronic device 804 or the server 806).

The wireless communication may include at least one of, for example, a long-term evolution (LTE), an LTE Advance (LTE-A), a code division multiple access (CDMA), a wideband CDMA (WCDMA), a universal mobile telecommunications system (UNITS), a wireless broadband (WiBro), a global system for mobile communications (GSM), or the like, as a cellular communication protocol. Furthermore, the wireless communication may include, for example, the local area or short-range wireless network 864. The local area network 864 may include at least one of a wireless fidelity (Wi-Fi), a Bluetooth, a near field communication (NFC), a magnetic stripe transmission (MST), a global navigation satellite system (GNSS), or the like.

The MST may generate a pulse in response to transmission data by using an electromagnetic signal, and the pulse may generate a magnetic field signal. The electronic device 801 may send the magnetic field signal to point of sale (POS). The POS may detect the magnetic field signal using a MST reader and may recover the data by converting the detected magnetic field signal to an electrical signal.

According to an embodiment, a wireless communication may include the GNSS. The GNSS may include at least one of a global positioning system (GPS), a global navigation satellite system (Glonass), a Beidou Navigation Satellite System (hereinafter referred to as "Beidou"), or an European global satellite-based navigation system (Galileo). In this specification, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 862 may include at least one of telecommunications networks, for example, a computer network (e.g., LAN or WAN), an Internet, or a telephone network.

Each of the first and second external electronic devices 802 and 804 may be a device of which the type is different from or the same as that of the electronic device 801. According to an embodiment, the server 806 may include a server or a group of two or more servers. According to various embodiments, all or a part of operations that the electronic device 801 will perform may be executed by another or plural electronic devices (e.g., the electronic device 802 or 804 or the server 806). According to an embodiment, in the case where the electronic device 801 executes any function or service automatically or in response to a request, the electronic device 801 may not perform the function or the service internally, but, alternatively additionally, it may request at least a portion of a function associated with the electronic device 101 from other devices (e.g., the electronic device 802 or 804 or the server 806). The other electronic device (e.g., the electronic device 802 or 804 or the server 806) may execute the requested function or additional function and may transmit the execution result to the electronic device 801. The electronic device 801 may provide the requested function or service by processing the received result as it is, or additionally. To this end, for example, cloud computing, distributed computing, or client-server computing may be used.

FIG. 9 is a block diagram illustrating an example electronic device, according to an example embodiment of the present disclosure.

Referring to FIG. 9, the electronic device 901 may include, for example, all or a part of the electronic device 801 illustrated in FIG. 8. The electronic device 901 may include one or more processors (e.g., including processing circuitry) 910 (e.g., the processor 140), a communication module (e.g., including communication circuitry) 920, a subscriber identification module 929, a memory 930 (e.g., the memory 120), a security module 936, a sensor module 940, an input device (e.g., including input circuitry) 950, a display 960, an interface (e.g., including interface circuitry) 970, an audio module 980, a camera module 991, a power management module 995, a battery 996, an indicator 997, and a motor 998.

The processor 910 may include various processing circuitry and drive an operating system (OS) or an application program to control a plurality of hardware or software elements connected to the processor 910 and may process and compute a variety of data. The processor 910 may be implemented with a System on Chip (SoC), for example. According to an embodiment of the present disclosure, the AP 910 may further include a graphic processing unit (GPU) and/or an image signal processor. The processor 910 may include at least a part (e.g., a cellular module 921) of elements illustrated in FIG. 9. The processor 910 may load and process an instruction or data, which is received from at least one of other components (e.g., a nonvolatile memory), and may store a variety of data in a nonvolatile memory.

The communication module 920 may be configured the same as or similar to a communication interface 870 of FIG. 8. The communication module 920 may include various communication circuitry, such as, for example, and without limitation, a cellular module 921, a Wi-Fi module 922, a Bluetooth (BT) module 923, a GNSS module 924 (e.g., a GPS module, a Glonass module, a Beidou module, or a Galileo module), a near field communication (NFC) module 925, a MST module 926, and a radio frequency (RF) module 927.

The cellular module 921 may provide voice communication, video communication, a character service, an Internet service, or the like through a communication network. According to an embodiment, the cellular module 921 may perform discrimination and authentication of the electronic device 901 within a communication network using the subscriber identification module 929 (e.g., a SIM card). According to an embodiment, the cellular module 921 may perform at least a portion of functions that the processor 910 provides. According to an embodiment, the cellular module 921 may include a communication processor (CP).

Each of the Wi-Fi module 922, the BT module 923, the GNSS module 924, the NFC module 925, or the MST module 926 may include a processor for processing data exchanged through a corresponding module, for example. According to an embodiment, at least a part (e.g., two or more elements) of the cellular module 921, the Wi-Fi module 922, the BT module 923, the GNSS module 924, the NFC module 925, or the MST module 926 may be included within one integrated circuit (IC) or an IC package.

The RF module 927 may transmit and receive, for example, a communication signal (e.g., an RF signal). For example, the RF module 927 may include a transceiver, a power amplifier module (PAM), a frequency filter, a low noise amplifier (LNA), an antenna, or the like. According to another embodiment, at least one of the cellular module 921, the Wi-Fi module 922, the BT module 923, the GNSS module 924, the NFC module 925, or the MST module 926 may transmit and receive an RF signal through a separate RF module.

The subscriber identification module 929 may include, for example, a card and/or embedded SIM which includes a subscriber identification module and may include unique identification information (e.g., integrated circuit card identifier (ICCID)) or subscriber information (e.g., integrated mobile subscriber identity (IMSI)).

For example, the memory 930 (e.g., the memory 830) may include an internal memory 932 and/or an external memory 934. For example, the internal memory 932 may include at least one of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash, a NOR flash, or the like)), a hard drive, or a solid state drive (SSD).

The external memory 934 may further include a flash drive such as compact flash (CF), secure digital (SD), micro secure digital (Micro-SD), mini secure digital (Mini-SD), extreme digital (xD), a multimedia card (MMC), a memory stick, or the like. The external memory 934 may be functionally and/or physically connected with the electronic device 901 through various interfaces.

The security module 936 may be a module that includes a storage space of which a security level is higher than that of the memory 930 and may include a circuit that guarantees safe data storage and a protected execution environment. The security module 936 may be implemented with a separate circuit and may include a separate processor. For example, the security module 936 may be in a smart chip or a secure digital (SD) card, which is removable, or may include an embedded secure element (eSE) embedded in a fixed chip of the electronic device 901. Furthermore, the security module 936 may operate based on an operating system (OS) that is different from the OS of the electronic device 901. For example, the security module 936 may operate based on java card open platform (JCOP) OS.

The sensor module 940 may measure, for example, a physical quantity or may detect an operating state of the electronic device 901. The sensor module 940 may convert the measured or detected information to an electric signal. For example, the sensor module 940 may include at least one of a gesture sensor 940A, a gyro sensor 940B, a barometric pressure sensor 940C, a magnetic sensor 940D, an acceleration sensor 940E, a grip sensor 940F, a proximity sensor 940G, a color sensor 940H (e.g., a red, green, blue (RGB) sensor), a biometric sensor 940I, a temperature/humidity sensor 940J, an illuminance (e.g., illumination) sensor 940K, or an UV sensor 940M. Although not illustrated, additionally or generally, the sensor module 940 may further include, for example, an E-nose sensor, an electromyography sensor (EMG) sensor, an electroencephalogram (EEG) sensor, an electrocardiogram (ECG) sensor, an infrared (IR) sensor, an iris sensor, and/or a fingerprint sensor. The sensor module 940 may further include a control circuit for controlling at least one or more sensors included therein. According to an embodiment, the electronic device 901 may further include a processor which is a part of the processor 910 or independent of the processor 910 and is configured to control the sensor module 940. The processor may control the sensor module 940 while the processor 910 remains at a sleep state.

The input device 950 may include various input circuitry, such as, for example, and without limitation, a touch panel 952, a (digital) pen sensor 954, a key 956, or an ultrasonic input device 958. The touch panel 952 may use at least one of capacitive, resistive, infrared and ultrasonic detecting methods. Also, the touch panel 952 may further include a control circuit. The touch panel 952 may further include a tactile layer to provide a tactile reaction to a user.

The (digital) pen sensor 954 may be, for example, a part of a touch panel or may include an additional sheet for recognition. The key 956 may include, for example, a physical button, an optical key, a keypad, and the like. The ultrasonic input device 958 may detect (or sense) an ultrasonic signal, which is generated from an input device, through a microphone (e.g., a microphone 988) and may verify data corresponding to the detected ultrasonic signal.

The display 960 (e.g., the display 860) may include a panel 962, a hologram device 964, or a projector 966. The panel 962 may be configured the same as or similar to the display 860 of FIG. 8. The panel 962 may be implemented to be flexible, transparent or wearable, for example. The panel 962 and the touch panel 952 may be integrated into a single module. The hologram device 964 may display a stereoscopic image in a space using a light interference phenomenon. The projector 966 may project light onto a screen so as to display an image. The screen may be arranged inside or outside the electronic device 901. According to an embodiment, the display 960 may further include a control circuit for controlling the panel 962, the hologram device 964, or the projector 966.

The interface 970 may include various interface circuitry, such as, for example, and without limitation, a high-definition multimedia interface (HDMI) 972, a universal serial bus (USB) 974, an optical interface 976, or a D-subminiature (D-sub) 978. The interface 970 may be included, for example, in the communication interface 870 illustrated in FIG. 8. Additionally or generally, the interface 970 may include, for example, a mobile high definition link (MHL) interface, a SD card/multimedia card (MMC) interface, or an infrared data association (IrDA) standard interface.

The audio module 980 may convert a sound and an electric signal in dual directions. At least a part of the audio module 980 may be included, for example, in the I/O interface 850 illustrated in FIG. 8. The audio module 980 may process, for example, sound information that is input or output through a speaker 982, a receiver 984, an earphone 986, or a microphone 113 (e.g., the first microphone 111, the second microphone 112, and the third microphone 113).

The camera module 991 for shooting a still image or a video may include, for example, at least one image sensor (e.g., a front sensor or a rear sensor), a lens, an image signal processor (ISP), or a flash (e.g., an LED or a xenon lamp).

The power management module 995 may manage, for example, power of the electronic device 901. According to an embodiment, the power management module 995 may include a power management integrated circuit (PMIC), a charger IC, or a battery or fuel gauge. The PMIC may have a wired charging method and/or a wireless charging method. The wireless charging method may include, for example, a magnetic resonance method, a magnetic induction method, or an electromagnetic method and may further include an additional circuit, for example, a coil loop, a resonant circuit, a rectifier, or the like. The battery gauge may measure, for example, a remaining capacity of the battery 996 and a voltage, current or temperature thereof while the battery is charged. The battery 996 may include, for example, a rechargeable battery and/or a solar battery.

The indicator 997 may display a specific state of the electronic device 901 or a part thereof (e.g., the processor 910), such as a booting state, a message state, a charging state, or the like. The motor 998 may convert an electrical signal into a mechanical vibration and may generate the following effects: vibration, haptic, and the like. Although not illustrated, the electronic device 901 may include a processing device (e.g., a GPU) for supporting a mobile TV. The processing device for supporting a mobile TV may process media data according to the standards of digital multimedia broadcasting (DMB), digital video broadcasting (DVB), MediaFlo™, or the like.

Each of the above-mentioned elements of the electronic device in the present disclosure may be configured with one or more components, and the names of the elements may be changed according to the type of the electronic device. According to various embodiments, the electronic device may include at least one of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 10:
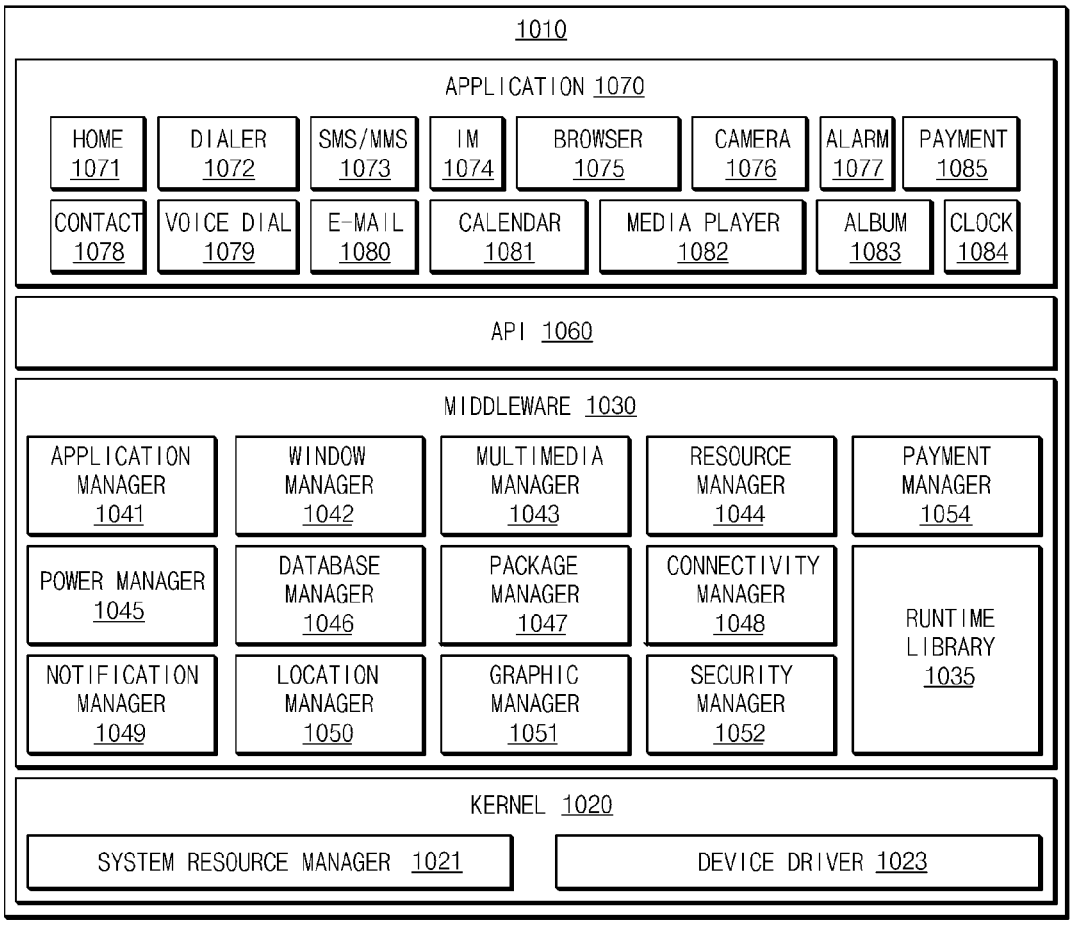
FIG. 10 is a block diagram illustrating an example program module, according to various example embodiments.

FIG. 10 is a block diagram illustrating an example program module, according to various example embodiments of the present disclosure.

According to an embodiment, a program module 1010 (e.g., the program 840) may include an operating system (OS) to control resources associated with an electronic device (e.g., the electronic device 801), and/or diverse applications (e.g., the application program 847) driven on the OS. The OS may be, for example, Android™, iOS™, Windows™, Symbian™, Tizen™, Bada™, or the like.

The program module 1010 may include a kernel 1020, a middleware 1030, an API 1060, and/or an application 1070. At least a part of the program module 1010 may be preloaded on an electronic device or may be downloadable from an external electronic device (e.g., the electronic device 802 or 804, the server 806, or the like).

The kernel 1020 (e.g., the kernel 841) may include, for example, a system resource manager 1021, or a device driver 1023. The system resource manager 1021 may perform control, allocation, or retrieval of system resources. According to an embodiment, the system resource manager 1021 may include a process managing part, a memory managing part, a file system managing part, or the like. The device driver 1023 may include, for example, a display driver, a camera driver, a Bluetooth driver, a common memory driver, an USB driver, a keypad driver, a Wi-Fi driver, an audio driver, or an inter-process communication (IPC) driver.

The middleware 1030 may provide, for example, a function which the application 1070 needs in common or may provide diverse functions to the application 1070 through the API 1060 to allow the application 1070 to efficiently use limited system resources of the electronic device. According to an embodiment, the middleware 1030 (e.g., the middleware 843) may include at least one of a runtime library 1035, an application manager 1041, a window manager 1042, a multimedia manager 1043, a resource manager 1044, a power manager 1045, a database manager 1046, a package manager 1047, a connectivity manager 1048, a notification manager 1049, a location manager 1050, a graphic manager 1051, a security manager 1052, or a payment manager 1054.

The runtime library 1035 may include, for example, a library module, which is used by a compiler, to add a new function through a programming language while the application 1070 is being executed. The runtime library 1035 may perform input/output management, memory management, capacities about arithmetic functions, or the like.

The application manager 1041 may manage, for example, a life cycle of at least one application of the application 1070. The window manager 1042 may manage a GUI resource which is used in a screen. The multimedia manager 1043 may identify a format necessary to play diverse media files, and may perform encoding or decoding of media files by using a codec suitable for the format. The resource manager 1044 may manage resources such as a storage space, memory, or source code of at least one application of the application 1070.

The power manager 1045 may operate, for example, with a basic input/output system (BIOS) to manage a battery or power, and may provide power information for an operation of an electronic device. The database manager 1046 may generate, search for, or modify database to be used in at least one application of the application 1070. The package manager 1047 may install or update an application which is distributed in the form of a package file.

The connectivity manager 1048 may manage, for example, wireless connection such as Wi-Fi or Bluetooth. The notification manager 1049 may display or notify an event such as an arrival message, an appointment, or a proximity notification in a mode that does not disturb a user. The location manager 1050 may manage location information of an electronic device. The graphic manager 1051 may manage a graphic effect to be provided to a user or a user interface relevant thereto. The security manager 1052 may provide a general security function necessary for system security, user authentication, or the like. According to an embodiment, in the case where an electronic device (e.g., the electronic device 801) includes a telephony function, the middleware 1030 may further includes a telephony manager for managing a voice or video call function of the electronic device.

The middleware 1030 may include a middleware module that combines diverse functions of the above-described elements. The middleware 1030 may provide a module specialized to each OS kind to provide differentiated functions. In addition, the middleware 1030 may remove a part of the preexisting elements, dynamically, or may add new elements thereto.

The API 1060 (e.g., the API 845) may be, for example, a set of programming functions and may be provided with a configuration which is variable depending on an OS. For example, in the case where an OS is the android or the iOS™, it may be permissible to provide one API set per platform. In the case where an OS is the Tizen™, it may be permissible to provide two or more API sets per platform.

The application 1070 (e.g., the application program 847) may include, for example, one or more applications capable of providing functions for a home 1071, a dialer 1072, an SMS/MMS 1073, an instant message (IM) 1074, a browser 1075, a camera 1076, an alarm 1077, a contact 1078, a voice dial 1079, an e-mail 1080, a calendar 1081, a media player 1082, an album 1083, and a clock 1084, a payment 1085, or for offering health care (e.g., measuring an exercise quantity or blood sugar) or environment information (e.g., information of barometric pressure, humidity, or temperature).

According to an embodiment, the application 1070 may include an application (hereinafter referred to as "information exchanging application" for descriptive convenience) to support information exchange between the electronic device (e.g., the electronic device 801) and an external electronic device (e.g., the electronic device 802 or 804). The information exchanging application may include, for example, a notification relay application for transmitting specific information to the external electronic device, or a device management application for managing the external electronic device.

For example, the information exchanging application may include a function of transmitting notification information, which arise from other applications (e.g., applications for SMS/MMS, e-mail, health care, or environmental information), to an external electronic device (e.g., an electronic device 802 or 804). Additionally, the information exchanging application may receive, for example, notification information from an external electronic device and provide the notification information to a user.

The device management application may manage (e.g., install, delete, or update), for example, at least one function (e.g., turn-on/turn-off of an external electronic device itself (or a part of components) or adjustment of brightness (or resolution) of a display) of the external electronic device (e.g., the electronic device 802 or 804) which communicates with the electronic device, an application running in the external electronic device, or a service (e.g., a call service, a message service, or the like) provided from the external electronic device.

According to an embodiment, the application 1070 may include an application (e.g., a health care application of a mobile medical device, and the like) which is assigned in accordance with an attribute of the external electronic device (e.g., the electronic device 802 or 804). According to an embodiment, the application 1070 may include an application which is received from an external electronic device (e.g., the server 806 or the electronic device 802 or 804). According to an embodiment, the application 1070 may include a preloaded application or a third party application which is downloadable from a server. The component titles of the program module 1010 according to the embodiment may be modifiable depending on kinds of operating systems.

According to various embodiments, at least a part of the program module 1010 may be implemented by software, firmware, hardware, or a combination of two or more thereof. At least a part of the program module 1010 may be implemented (e.g., executed), for example, by a processor (e.g., the processor 910). At least a portion of the program module 1010 may include, for example, a module, a program, a routine, sets of instructions, or a process for performing one or more functions.

The term "module" used herein may refer, for example, to a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of a dedicated processor, a CPU, an application-specific IC (ASIC) chip, a field-programmable gate array (FPGA), and a programmable-logic device for performing some operations, which are known or will be developed.

At least a portion of an apparatus (e.g., modules or functions thereof) or a method (e.g., operations) according to various embodiments of the present disclosure may be, for example, implemented by instructions stored in a computer-readable storage media in the form of a program module. The instruction, when executed by a processor (e.g., the processor 820), may cause the one or more processors to perform a function corresponding to the instruction. According to an embodiment, a computer recording medium storing an instruction that is executed by at least one processor and is readable by a computer, the instruction, when executed by the processor, causing the computer to change a sound, which is obtained from the first microphone for a specific time period, into a first signal, to change a sound, which is obtained from the second microphone arranged at a location spaced apart from the first microphone, into a second signal, and to recognize the sound, which is generated for the time period, as a voice or a noise based on a frequency-related correlation between the first signal and the second signal. The computer-readable storage media, for example, may be the memory 830.

A computer-readable recording medium may include a hard disk, a magnetic media, a floppy disk, a magnetic media (e.g., a magnetic tape), an optical media (e.g., a compact disc read only memory (CD-ROM) and a digital versatile disc (DVD), a magneto-optical media (e.g., a floptical disk), and hardware devices (e.g., a read only memory (ROM), a random access memory (RAM), or a flash memory). Also, a program instruction may include not only a mechanical code such as things generated by a compiler but also a high-level language code executable on a computer using an interpreter. The above hardware unit may be configured to operate as one or more software modules to perform an operation according to various embodiments, and vice versa.

Modules or program modules according to various embodiments may include at least one or more of the above-mentioned elements, some of the above-mentioned elements may be omitted, or other additional elements may be further included therein. Operations executed by modules, program modules, or other elements according to various embodiments may be executed by a successive method, a parallel method, a repeated method, or a heuristic method. In addition, a part of operations may be executed in different sequences or may be omitted. Alternatively, other operations may be added.

According to various embodiments of the present disclosure, the accuracy for determining a noise interval may be improved by distinguishing between a voice interval and a noise interval based on a correlation between two or more signals obtained by two or more microphones.

Besides, a variety of effects directly or indirectly understood through this disclosure may be provided.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a first microphone;

a second microphone disposed at a location spaced apart from the first microphone;

an audio converter comprising audio converting circuitry; and a processor electrically connected with the first microphone, the second microphone, and the audio converter, wherein the processor is configured to:

through the first microphone and the second microphone, receive a sound generated for a specific time period, from the outside;

convert the sound obtained from the first microphone into a first signal and convert the sound obtained from the second microphone into a second signal, using the audio converter;

determine the sound, which is generated for the specific time period, as a voice if a value associated with a difference between energy of the first signal and energy of the second signal is greater than a specific energy value and a value associated with at least one of spectral variance of the first signal or spectral variance of the second signal is greater than a specified variance value;

determine the sound, which is generated for the specific time period, as the voice or a noise based on a magnitude squared coherence (MSC) of the first signal and the second signal if the value associated with a difference between the energy of the first signal and the energy of the second signal is less than the specific energy value or the value associated with at least one of the spectral variance of the first signal or the spectral variance of the second signal is less than the specified variance value; and amplify the sound which is determined as the voice or attenuate the sound which is determined as the noise.

2. The electronic device of claim 1, wherein the first microphone is exposed through an upper portion of a housing of the electronic device, and wherein the second microphone is exposed through a lower portion or a side surface of the housing of the electronic device.

3. The electronic device of claim 1, wherein a frequency band of the sound, which is determined as the voice, is changed based on a distance between the first microphone and the second microphone.

4. The electronic device of claim 1, further comprising:

a third microphone disposed at a location spaced apart from the first microphone and the second microphone, wherein the processor is configured to:

through the first microphone, the second microphone, and the third microphone, receive the sound generated for the specific time period, from the outside;

convert the sound obtained from the third microphone into a third signal, using the audio converter; and determine the sound, which is generated for the specific time period, as the voice or the noise based on at least one of: a correlation between the first signal and the second signal, a correlation between the second signal and the third signal, or a correlation between the third signal and the first signal.

5. The electronic device of claim 4, wherein the processor is configured to:

assign different weights to the correlation between the first signal and the second signal, the correlation between the second signal and the third signal, and the correlation between the third signal and the first signal based on a distance between the first microphone and the second microphone, a distance between the second microphone and the third microphone, and a distance between the third microphone and the first microphone, respectively.

6. A voice and noise classification method of an electronic device comprising a first microphone, and a second microphone which is disposed at a location spaced apart from the first microphone, the method comprising:

receiving a sound generated for a specific time period, from the outside, via the first microphone and the second microphone;

converting the sound obtained from the first microphone into a first signal;

converting the sound obtained from the second microphone into a second signal;

determining the sound, which is generated for the specific time period, as a voice if a value associated with a difference between energy of the first signal and energy of the second signal is greater than a specific energy value and a value associated with at least one of spectral variance of the first signal or spectral variance of the second signal is greater than a specified variance value;

determining the sound, which is generated for the specific time period, as the voice or a noise based on a magnitude squared coherence (MSC) of the first signal and the second signal if the value associated with a difference between the energy of the first signal and the energy of the second signal is less than the specific energy value or the value associated with at least one of the spectral variance of the first signal or the spectral variance of the second signal is less than the specified variance value; and amplifying the sound which is determined as the voice or attenuating the sound which is determined as the noise.

7. The method of claim 6, further comprising:

receiving the sound via a third microphone disposed at a location spaced apart from the first microphone and the second microphone;

converting the sound obtained from the third microphone into a third signal, wherein the determining of the sound as the voice or the noise comprises:

determining the sound, which is generated for the specific time period, as the voice or the noise based on at least one or more of: a correlation between the first signal and the second signal, a correlation between the second signal and the third signal, or a correlation between the third signal and the first signal.

8. The method of claim 7, wherein the determining of the sound as the voice or the noise comprises:

assigning different weights to the correlation between the first signal and the second signal, the correlation between the second signal and the third signal, and the correlation between the third signal and the first signal based on a distance between the first microphone and the second microphone, a distance between the second microphone and the third microphone, and a distance between the third microphone and the first microphone, respectively.

* * * * *